United States Patent [19]

Vann

[11] Patent Number: 4,484,632

[45] Date of Patent: Nov. 27, 1984

[54] WELL COMPLETION METHOD AND APPARATUS

[75] Inventor: Roy R. Vann, Houston, Tex.

[73] Assignee: GEO Vann, Inc., Houston, Tex.

[21] Appl. No.: 412,930

[22] Filed: Aug. 30, 1982

[51] Int. Cl.[3] ..... E21B 43/116

[52] U.S. Cl. ..... 166/297; 175/4.52; 175/4.54; 166/55

[58] Field of Search ..... 175/4.52, 4.54, 4.56, 175/4.5, 4.51, 301; 166/55, 55.1, 299, 297, 63, 72

[56] References Cited

U.S. PATENT DOCUMENTS

| | | | |
|---|---|---|---|
| 2,749,840 | 6/1956 | Babcock | 175/4.56 X |
| 3,011,551 | 12/1961 | Young et al. | 175/4.52 |
| 3,118,508 | 1/1964 | Friedman et al. | 175/4.51 |
| 3,189,094 | 6/1965 | Hyde | 175/4.52 |
| 3,215,074 | 11/1965 | Robinson et al. | 175/4.5 |
| 3,305,018 | 2/1967 | White et al. | 166/297 |
| 3,642,070 | 2/1972 | Taylor et al. | 166/374 X |

*Primary Examiner*—James A. Leppink
*Assistant Examiner*—Michael Starinsky

[57] ABSTRACT

A pipe string with a valve, pressure responsive means, packer, firing mechanism and perforating gun are suspended within a well to complete the well. The packer is set to form an upper and lower annulus, and the valve and pressure responsive means are disposed above the packer in the upper annulus. A force transmission means extends from the pressure responsive means to the firing mechanism in the lower annulus. The valve is initially closed to prevent fluid flow through the flow bore of the pipe string. The upper annulus is pressurized to open the valve and create a pressure differential across the pressure responsive means. The pressure responsive means then transmits a force through the force transmission means to the firing mechanism to actuate the firing mechanism and detonate the perforating gun. Hydrocarbons from the formation then flows through the perforations and up the flow bore of the pipe string to the surface.

41 Claims, 12 Drawing Figures

WELL COMPLETION METHOD AND APPARATUS

BACKGROUND OF THE INVENTION

This invention relates to apparatus and methods for use in oil and/or gas wells or the like and more particularly to apparatus and methods for testing a hydrocarbon producing formation and/or completing one or more hydrocarbon producing formations.

One method for testing a formation in a cased well includes running an electric line casing gun perforator in mud of sufficient weight to control the well pressure, perforating the casing adjacent the zone to be tested, and then withdrawing the perforating gun. Test tools are then run into the well on a pipe string with well pressure being controlled with casing fluid of appropriate weight. A packer is set to close the annulus and a valve is opened in the pipe string to permit fluids from the formation to flow through the pipe string to the surface.

Another method for testing a formation includes running a tool string on drill pipe into the cased borehole with the tool string including full opening test tools with a full opening valve, and a packer disposed on the tool string for packing off the annulus. The casing adjacent the zone to be tested is packed off with the packer and the full opening valve is then opened providing fluid communication between the flow bore of the tubing string and the lower packed off portion of the casing. A small through-tubing perforating gun is lowered on an electric line through the test tools, and the casing adjacent the zone is perforated. The wireline perforating gun is then lubricated out of the well. Although additional through-tubing perforating guns can be lowered into the well to cover zones with long intervals, only the first perforation can be done with an underbalance so as to provide a negative pressure towards the tubing flow bore from the formation.

The latter method is particularly troublesome in high temperature wells where the mud contains solids such as barite. When the valve opens and pressure is removed from the mud below the valve, the water boils causing the barite to harden in the string below the valve. This can prevent through tubing perforating guns from passing through the tool string.

Another method is disclosed in the Halliburton U.S. Pat. No. 2,169,559. In Halliburton, a formation tester, sub, packer, perforated pipe, perforating gun, and bull plug are all suspended on the end of a drill pipe string. The formation tester includes a limited opening valve and mandrel for opening the valve. The valve includes a depending rod extending through a gland located in the sub. Adjacent the gland are a number of passageways to permit fluid flow from a point beneath the sub and into the formation tester. The sub also includes a switch contact connected to a battery with an electrical conductor which extends downwardly through the packer and is connected to the perforating gun. The bull plug below the perforating gun may include a pressure recording apparatus. In operation, the packer is set to seal the lower portion of the well from the portion above the packer and the drill pipe is rotated and lowered causing the mandrel to open the valve in the formation tester. This automatically starts the firing of the gun since as the valve stem moves downwardly to unseat, the depending rod makes electrical contact with the electrical conductor in the sub to detonate the perforating gun. Any fluid in the formation then flows through the perforations and through the perforated pipe above the perforating gun. This fluid must then pass through the limited openings of the passageways in the sub and of the valve and into the drill pipe. After a sufficient length of time the drill pipe is raised thus lifting the mandrel off the valve stem to allow the valve to close. When the valve closes, a sample of the fluid from the formation is entrapped in the drill pipe. The packer is then released and the entire assembly is removed from the well with the entrapped sample.

As is now well known in the art of completing oil and/or gas wells, a perforating gun is lowered into the cased borehole and the well is perforated by shooting perforations through the casing, cement and into the hydrocarbon formation to permit the hydrocarbons to flow into cased borehole and up to the surface. U.S. Pat. No. 3,706,344 to Vann discloses suspending a packer and perforating gun on a tubing string, setting the packer to isolate the production zone, releasing the trapped pressure below the packer by opening the tubing string to fluid flow, actuating the perforating gun through the tubing string, and immediately producing the well through the tubing string upon perforation. One means for actuating the perforating gun includes dropping a bar through the tubing string to impact the firing head of the perforating gun.

However, after a borehole has been drilled into the ground and the casing cemented into position, well fluids fill the cased borehole with drilling mud and debris. The mud and debris gravitate towards the lower end of the cased borehole and tend to densify and congeal into a heavy layer of material. Such drilling mud and debris also will settle and congeal in the tubing string and collect around the firing head of the perforating gun. Further, other debris inside the tubing string such as flakes, rust, sand, scale and other material dropped into well from the surface, tend to collect in the bottom of the string. Often such debris becomes dislodged and falls down through the tubing string as the string is handled and lowered into the well. Again, these heavy particles and other suspended matter will gravitate to the bottom of the string where such contaminates densify into a heavy layer of material around the firing head.

In a perforating gun having a bar actuated gun firing head for example, it is possible for such contaminates to densify and collect about the gun firing head mechanism and become so compacted and viscous that the gun firing head cannot be sufficiently impacted to detonate the perforating gun. If the bar is unable to sufficiently strike the firing mechanism, the gun will not be detonated. The problem of debris and contamination is compounded when the string is left downhole for a substantial length of time.

The present invention overcomes these deficiencies as hereinafter described.

SUMMARY OF THE INVENTION

The method and apparatus of the present invention includes testing a hydrocarbon-containing formation located downhole in a borehole, by running formation test tools and a perforating gun apparatus downhole on the end of a pipe string in a single trip into the well. The formation test tools include either a full opening or non-full opening valve, and appropriate pressure-temperature instruments. The perforating gun apparatus includes a firing mechanism with flow ports opening into the lower annulus and a casing type perforating gun. The firing head preferably includes a pressure reponsive means disposed in the pipe string above the packer and a firing mechanism adjacent the perforating gun whereby upon creating a pressure differential between the upper borehole annulus above the packer and the tubing flow bore and applying that pressure differential across the pressure responsive means, the pressure responsive means transmits a signal to the firing mechanism which activates the firing mechanism to detonate the perforating gun.

Accordingly, a primary object of the present invention is the provision of a method and apparatus for testing the formation in a single trip into the well with the test tools and perforating gun.

Another object of the present invention is the provision of a perforating gun of the casing type to achieve deeply penetrating perforations into the formation.

Still a further object of this invention is the provision of a method and apparatus for testing the formation with an under-balance which will produce high back-surge pressures and maximum flow.

Another and still further object of the present invention is the actuation of the perforating gun without the necessity of pressuring down the flow bore of the pipe string.

An additional object of the present invention is the provision of a method and apparatus which will permit the lowering of formation test tools and perforating guns in a single trip into the well and still use non-full opening test tools.

A further object of this invention is the provision of a system for detonating the perforating gun which does not require the lowering of a tool such as a bar, through the pipe string which might not reach the bottom due to mud, debris, or other contamination.

Another object of the methods and apparatus of the present invention is to improve test results on the samples taken from the test formation.

An additional object of the present invention is the improvement in shot detection through the elimination of unnecessary noise such as that caused by the dropping of a bar through the pipe string.

A further object of the present invention is the elimination of the need for heavy mud to insure the well is killed since the perforating gun is suspended on the end of a tool string having a packer.

Still another object of the present invention is the elimination of running a wireline casing gun into the well and running a string into the well to pressure test the packer.

Another object of the present invention is the provision of a method and apparatus by which a payzone located downhole adjacent to the borehole can be tested in a safe and dependable manner.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above summary.

Other objects and advantages of the invention will appear from the following description.

BRIEF DESCRIPTION OF THE DRAWINGS

For a detailed description of the embodiments of the apparatus and methods of the present invention, reference will now be made to the accompanying drawings wherein.

DESCRIPTION OF THE PREFERRED EMBODIMENT

Figure 1:
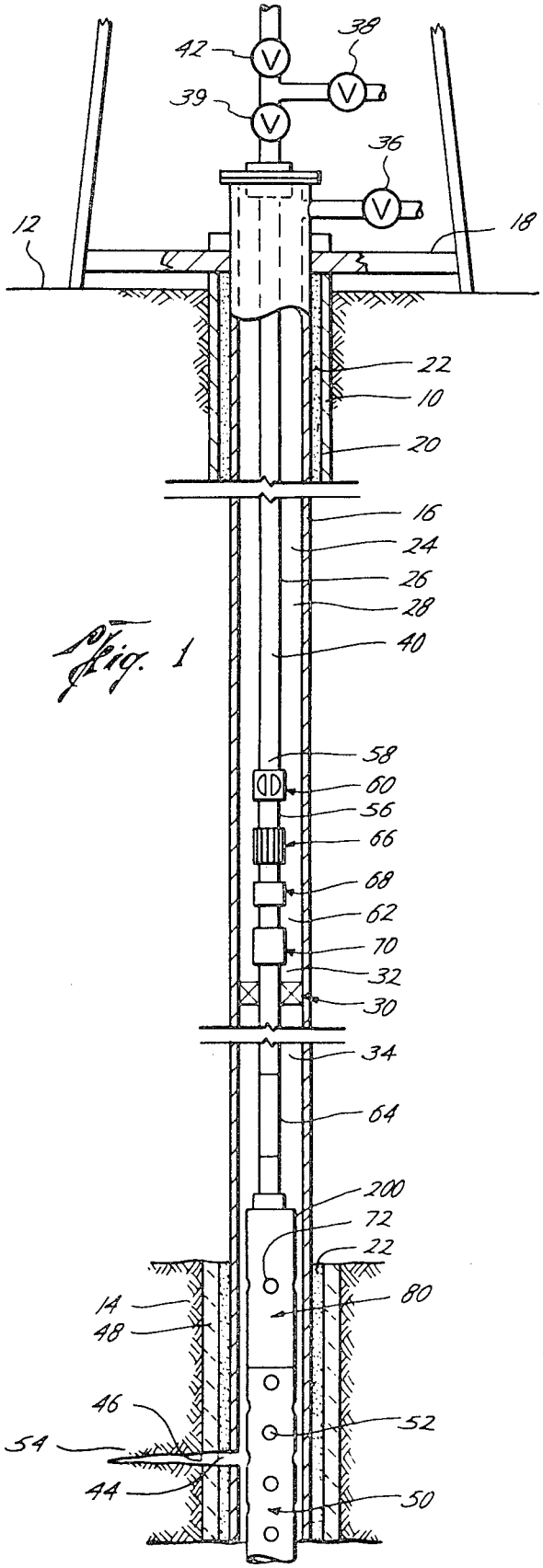
FIG. 1 is a fragmentary, part cross-sectional view of a borehole having apparatus made in accordance with the present invention for testing a formation.

Referring initially to FIG. 1, there is disclosed a borehole 10 extending downhole from the surface 12 of the ground through a hydrocarbon-containing formation 14. The borehole 10 is cased by a string of casing 16 hung from the floor of rig 18 and within surface casing 20. Casing string 16 is cemented into borehole 10 and casing 20 as shown at 22 and set in a casing hanger. Casing 16 isolates the wellbore 24 from formation 14. A string of production tubing 26 is suspended from rig 18 and extends from the surface 12 axially through casing 16. Tubing 26 within casing 16 forms borehole annulus 28, and packer 30, disposed on tubing 26, divides the borehole annulus 28 into an upper annulus 32 and a lower annulus 34. Suitable outlets are provided at the rig 18 for the tubing flow bores and each annulus formed by adjacent casing strings with each of the outlets being provided with suitable valves and the like, including valve 36 for the outlet communicating with the borehole annulus 28 and valves 38, 39 for the outlet communicating with the flow bore 40 of tubing string 26. A lubricator 42 is provided for access to tubing flow bore 40 for the use of slick line tools.

In order to complete the well or test the formation, it is necessary to access the hydrocarbons in formation 14 with the wellbore 24. This is accomplished by supporting a perforating gun 50 at the lower end of the tubing string 26. Gun 50 is preferably a jet casing gun, but it should be understood that the term is intended to include any means for communicating the hydrocarbon-producing formation 14 with lower annulus 34. The jet perforating gun of the casing type shoots metallic particles into the formation 14 to form perforations 44 and corresponding channels or tunnels 46. Numerals 44 and 46 broadly indicate one of a plurality of perforations and tunnels which are formed when the charges 52 of gun 50 are detonated. Perforating objectives include perforations of a desired size and configuration, prevention of further formation invasion and contamination during the perforating process, and maximum capacity to move the hydrocarbons from formation 14 to lower annulus 34.

During the drilling of the borehole 10, the formation pressures are controlled by weighted drilling fluid, filtrate and perhaps fines which invade the formation, interacting with in situ solids and fluids to create a contaminated zone 48, reducing permeability, and leaving on the face of formation 14 a low-permeability filter cake. The cementing operation also includes fluids and fines which invade and damage the formation 14 at the contaminated zone 48. Thus, the jet perforating gun 50 of the casing type using shaped charges 52 must penetrate deeply into the formation 14 to form tunnels 46 that pass through casing 16, cement 22, and contaminated zone 48 and into the uncontaminated or sterile zone 54 of formation 14. Perforations 44 and tunnels 46 form the final passageways which enable the hydrocarbons to flow from the formation 14, through tunnels 46 and perforations 44 and into lower annulus 34 for movement to the surface 12.

Various tool strings may be included with tubing string 26, packer 30, and gun 50 to complete the well and/or test the formation. FIG. 1 illustrates one variation of a tool string to test or sample the hydrocarbons contained in formation 14. As shown, the tool string includes tubing string 26, a valve 60, pressure-temperature instruments 66, a safety joint 68, a pressure responsive means 70, packer 30, a plurality of flow ports 72, a firing mechanism 80 and casing perforating gun 50. Although the method of operation will be hereinafter set forth in greater detail, briefly, formation 14, is tested by setting packer 30, pressurizing upper annulus 32 to open valve 60 and activate pressure responsive means 70, cocking and firing mechanism 80 through the activation of pressure responsive means 70, detonating gun 50, perforating formation 14 and flowing hydrocarbons into the lower annulus 34, through flow ports 72, and up tubing flow bore 40 to the outlet 38.

Pressure-temperature instruments 66 are series connected in tubing string 26 to record subsurface well pressures and temperatures throughout the formation test. Such instruments may include the B.T. (Bourdon Tube) pressure recorder and/or temperature recorder manufactured by Halliburton and described at pages 3991–2 of the 1982–83 *Composite Catalog of Oilfield Equipment and Services.*

Valve 60 may be of various types used for formation testing and be actuated by hydraulic pressure, reciprocation or rotation. Common hydraulically actuated valves are the PCT (Pressure-Controlled Test) valves manufactured by Johnston-Macco of Schlumberger and the APR (Annulus Pressure Responsive) valves manufactured by Halliburton described at pages 4986 and 4003–4, respectively, of the 1982–83 *Composite Catalog of Oilfield Equipment and Services.* The Johnston PCT sleeve valve uses annular pump pressure open the valve and hold it open. When the annulus pressure is bled off, a coil spring and nitrogen pressure in the valve automatically closes the valve.

Safety joint 68 is used in instances where downhole tools have become stuck due to hole sloughing, cavings or similar conditions and may be the type manufactured by Halliburton and described at page 3999 of the 1982–83 *Composite Catalog of Oilfield Equipment and Services.*

Packer 30 may be various types but preferably is a hook wall packer such as Halliburton RTTS hook wall packer described at page 3997 of the 1982–83 *Composite Catalog of Oilfield Equipment and Services.* Packer 30 could also be a hydraulically-set packer or a permanent packer.

Flow ports 72 may in any member below packer 30 and valve 60 to facilitate flow between lower borehole annulus 34 and tubing flow bore 40. As shown in FIG. 1, flow ports 72 are disposed in firing mechanism 80. However, a perforated nipple with flow ports 72 could also be series connected in tubing string 26 anywhere below packer 30.

EMBODIMENT OF FIGS. 2–6

Referring now to the drawings in detail and first to FIGS. 2–6, FIGS. 2A and 2B depicts pressure responsive means 70 which is series connected in tubing string 26 above packer 30 of FIG. 1. Pressure responsive means 70 includes an annular chamber 74, piston means 76, pressure communication means 78 and force transmission means 82.

Pressure responsive means 70 includes a tubular body 84 having a cylinder 86 and mandrel 88. Mandrel 88 has a lower enlarged diameter portion 90, a threaded medial portion 92, and an upper reduced diameter tubular portion 94. Cylinder 86 telescopingly receives tubular portion 94 and has threads at its lower end for threading engagement at 96 with medial portion 92 of mandrel 88. Set screws 98 threadingly extend through tapped bores in the lower end of cylinder 86 to engage the bottom of a groove 100 around median portion 92 adjacent shoulder 102 formed by portions 90 and 92. The lower end of cylinder 86 engages shoulder 102.

Means for making rotary shouldered connections with adjacent drill pipe members 104, 106 are provided at the upper end of cylinder 86 and lower end of mandrel 88, e.g. a tapered threaded pin 108 and shoulder 110 at the bottom and a correlative threaded box 112 with shoulder 114 at the top. Thus, threaded box 112 threadingly receives the pin end of upper drill pipe member 104 and the threaded pin 108 is inserted into the box end of lower drill pipe member 106. Drill pipe member 106 is the upper member of drill pipe string 64 extending from pressure responsive means 70 to firing mechanism 80. Rotary shouldered connections are provided since the rig operator generally uses the pipe readily available at the well site. Since that pipe, such as members 104, 106, is often drill pipe or drill collars, the connections on tubular body 84 must have rotary shouldered connections to be compatible.

Piston means 76 includes a piston sleeve 116 dimensioned to be received in the annular space 118 formed between cylinder 86 and tubular portion 94 of mandrel 88. Sleeve 116 has an enlarged lower end 120 which is slidably mounted within annular space 118 and a reduced inner and outer diameter upper end 122 having clearance with the walls 124, 126 of tubular portion 94 and cylinder 86 respectively. Upper end 122 of sleeve 116 extends upwardly beyond the free end of tubular portion 94 and out of annular space 118. Inner and outer O-rings 128, 130 respectively, are housed in annular grooves in the inner and outer peripheral surfaces of piston sleeve 116 for sealingly engaging the walls 124, 126 of tubular portion 94 and cylinder 86 respectively.

Annular pressure chamber 74 is that lower portion of annular space 118 between the lower end 132 of piston sleeve 116 and shoulder 134 formed by tubular portion 94 and medial portion 92. Piston sleeve 116 and tubular portion 94 have cooperating annular shoulders at 136 to limit the downward movement of sleeve 116 within annular space 118.

Pressure communication means 78 includes a plurality of ports 140 extending radially through the lower end of cylinder 86 above threads 96. Ports 140 provide fluid communication between upper borehole annulus 32 and pressure chamber 74. Thus, the fluid pressure of upper borehole annulus 32 is applied to the lower end 132 of piston sleeve 116. Shear pins 138 extend through apertures in the lower end of sleeve 116 and into blind bores in tubular portion 94 below shoulders 136. Shear pins 138 prevent the upward movement of piston sleeve 116 in annular space 118 until a predetermined pressure differential is applied across piston sleeve 116 which is sufficient to shear pins 138, as will be more fully described hereinafter.

Force transmission means 82 includes a cable 142 extending from pressure responsive means 70 to firing mechanism 80, attachment means 144 for attaching the upper end of cable 142 to piston means 76, and biasing means 146 for biasing attachment means 144 in the direction of the firing mechanism 80.

Figure 2A:
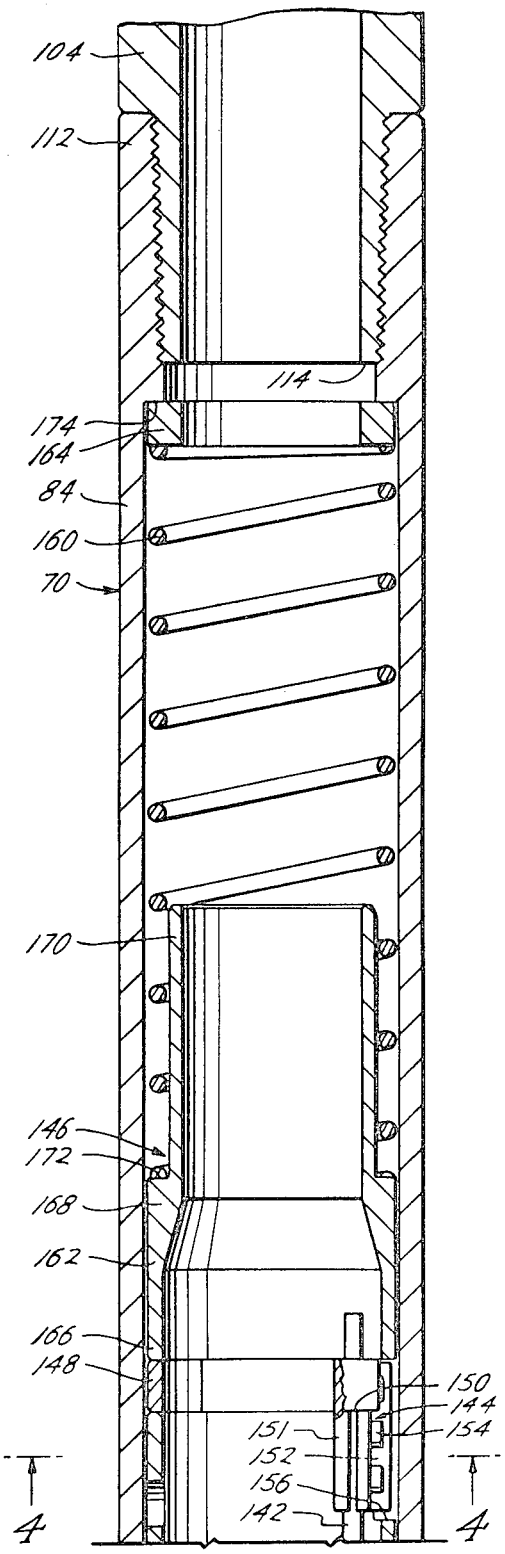
FIGS. 2A and 2B are enlarged cross-sectional views of the pressure responsive means of the apparatus shown in FIG. 1.
Figure 2B:
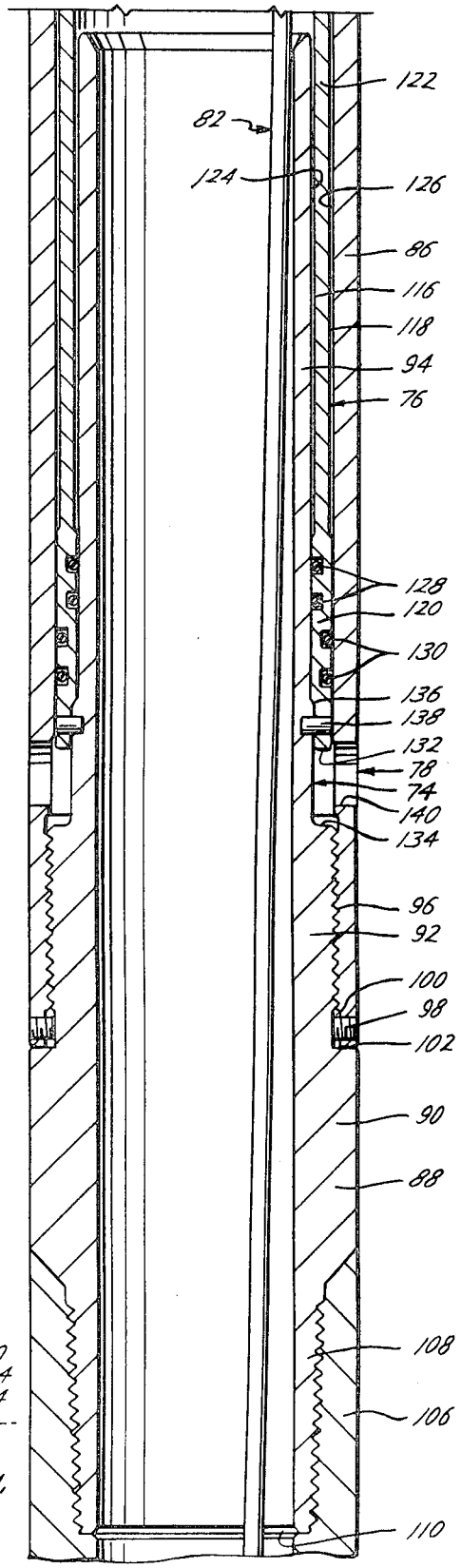
Figure 4:
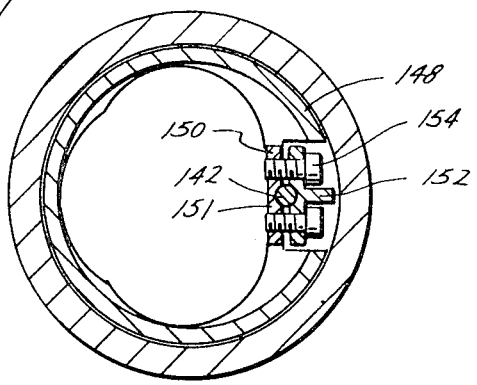
FIG. 4 is a cross-sectional view of the pressure responsive means of FIG. 2 taken at plane 4—4 in FIG. 2.
Figure 5:
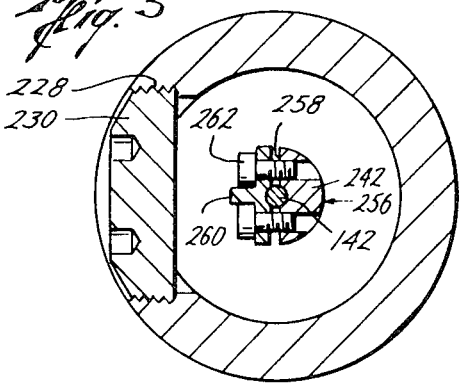
FIG. 5 is a cross-sectional view of the firing mechanism taken at plane 5—5 in FIG. 3.

Referring now to both FIGS. 2A, 2B and 4 illustrating attachment means 144, means 144 includes a ring 148 disposed on top of piston sleeve 116, and clamp 150 extending downwardly from ring 148. Clamp 150 includes a vertical plate 151 affixed to ring 148 and a T-plate 152 with screws 154 for threading engagement with vertical plate 151 to clamp cable 142 to ring 148. A vertical slot 156 is provided in the upper end of piston sleeve 116 to receive the downwardly extending portion of clamp 150. The open area through ring 148 with clamp 150 is equivalent to that of the flow bore. Thus, there is no flow restriction through attachment means 144.

Biasing means 146 includes a spring 160 with a tubular retainer 162 at the bottom and a stop ring 164 at the top. Tubular retainer 162 has a lower tubular portion 166, a transition portion 168 and an upper reduced outer diameter portion 170. Transition portion 168 and upper portion 170 form a bearing shoulder 172 for engagement with one end of spring 160 as spring 160 is telescopingly received over upper reduced outer diameter portion 170. Stop ring 164 is disposed between the upper end of spring 160 and opposing shoulder 174 formed at the box end 112 of cylinder 86. As the assembly of piston means 76 and transmission means 82 move toward shoulder 174, spring 160 is compressed within cylinder 86.

A weight may be removably affixed to the lower end of cable 142, such as by set screws, for stringing cable 142 down through drill pipe string 64 to facilitate the connection of the lower end of cable 142 to firing mechanism 80.

Figure 3A:
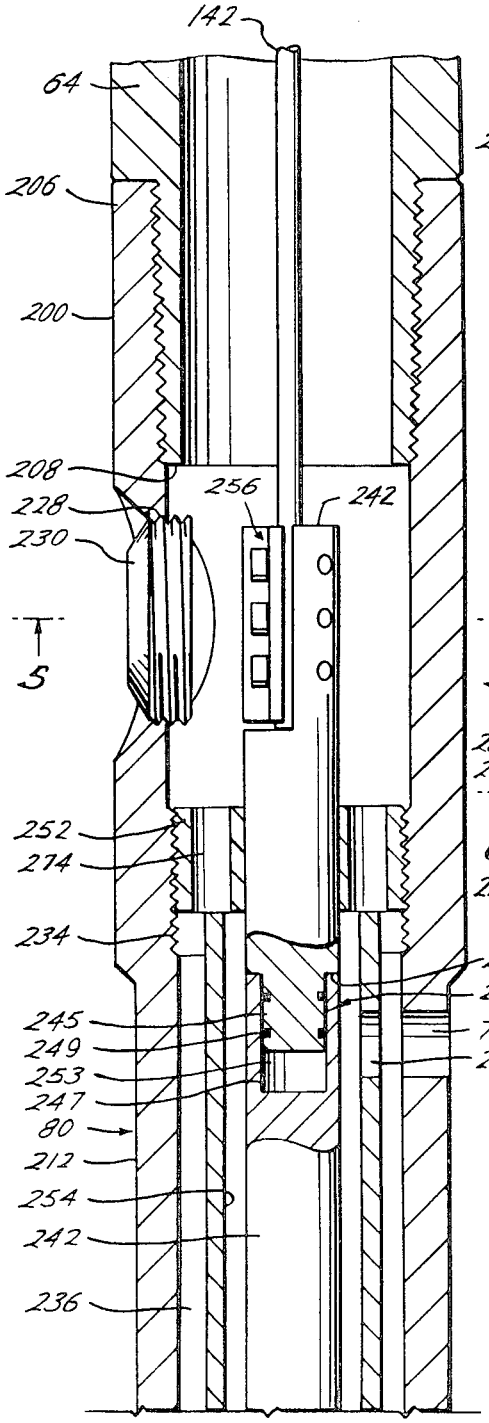
FIGS. 3A and 3B are enlarged cross-sectional views of the firing mechanism of the apparatus shown in FIG. 1.
Figure 3B:
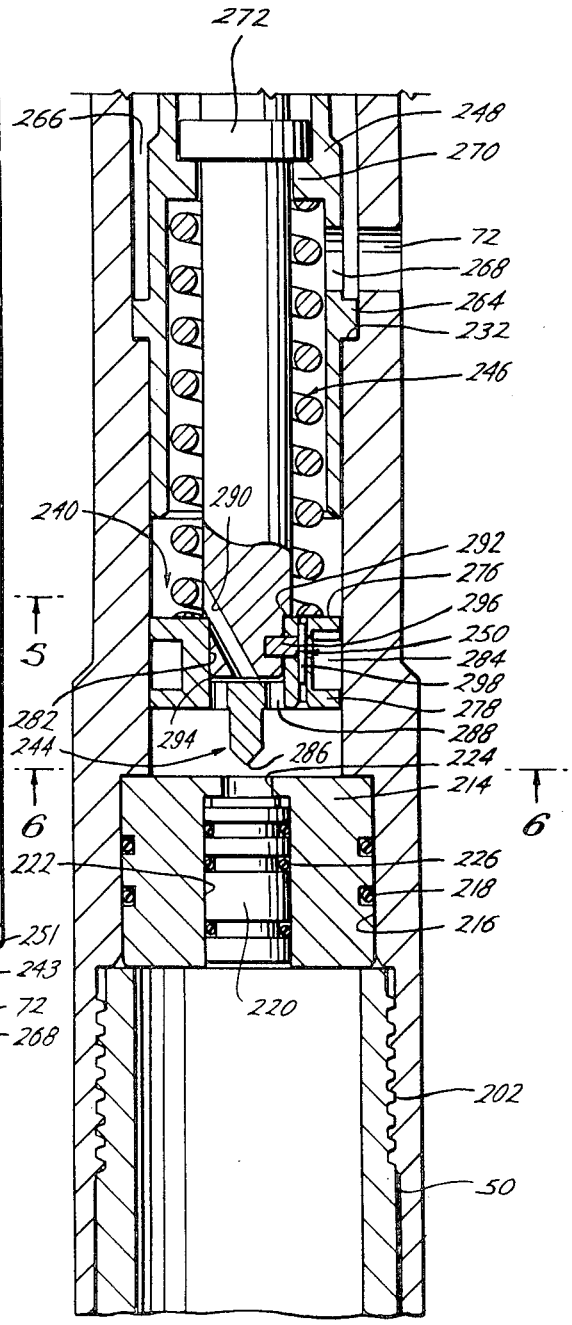

Referring now to FIGS. 3A and 3B, gun firing mechanism 80 includes a generally cylindrical housing 200 and a detonator means 240. Housing 200 is threadingly secured by means of threads 202 to one end of perforating gun 50. Seal means (not shown) are provided for sealing the connection between gun 50 and firing mechanism 80. Although FIG. 1 discloses firing mechanism 80 disposed uphole or on top of gun 50, firing mechanism 80 could be disposed downhole or on the bottom of gun 50. If mechanism 80 were on the bottom of gun 50, force transmission means 82 would be adapted to extend from pressure responsive means 70 to firing mechanism 80 below gun 50. As shown in FIG. 1, housing 200 extends upwardly and is connected at its upper end to drill pipe string 64 including drill pipe member 106 attached to the lower end of pressure responsive means 70. Means for making a rotary shouldered connection with pipe string 64 is provided at the upper end of housing 200, e.g. a correlative threaded box 206 with shoulder 208 at the top. Thus, threaded box 206 threadingly receives the pin end of the lowermost drill pipe member in pipe string 64.

Housing 200 includes a medial reduced diameter portion 212 having a plurality of flow ports 72 therethrough for communicating lower borehole annulus 34 with the interior bore 236 of housing 200. A sealed plug 214 is received within a counterbore 216 in the lower end of housing 200. Plug 214 is sealed with the wall of counterbore 216 by seal means 218, such as O-rings housed in annular grooves in plug 214. Plug 214 includes a coaxial bore 222 within which is disposed an initiator 220 for initiating the detonation of gun 50. Bore 222 has a reduced diameter entrance 224 for receiving firing pin 244 described hereinafter. Seal means 226, such as O-rings, are provided to seal initiator 220 within bore 222.

Adjacent the box end 206 of housing 200 is a large threaded bore 228 threadingly receiving a closure plug 230. Bore 228 permits access to the interior of housing 200 for the attachment of the lower end of cable 142 to firing mechanism 80 as hereinafter described.

The interior of housing 200 includes an inwardly projecting annular shoulder 232 below ports 72 and interior threads 234 above ports 72 for the installation of detonator means 240 as hereinafter described.

Detonator means 240 includes a shaft 242, firing pin 244, a coiled spring 246, a tubular member 248, a shear connection 250, and a retainer ring 252. Firing pin 244 is releasably affixed to one end of shaft 242 by shear connection 250 and is disposed in the lower part of bore 236 of housing 200 adjacent entrance 224 to initiator 220. The shaft 242 extends upwardly through the bore 254 of tubular member 248 and is attached at its other end to the lower end of cable 142 by connection means 256. Connection means 256, shown in FIG. 5, includes a vertical flat 258 at the end of shaft 242 and a T-plate 260. T-plate 260 and flat 258 have opposing vertical half grooves for receiving the lower end of cable 142. Set screws 262 are provided for securing T-plate 260 to flat 258 so as to securely connect the lower end of cable 142 to shaft 242.

Tubular member 248 includes an outwardly projecting annular flange 264 slidably engaging the interior wall of housing 200 and being disposed on shoulder 232 thereby limiting the insertion of member 248 within bore 236 of housing 200. That portion 266 of tubular member 248 extending toward initiator 220 from flange 264 is slidably received within bore 236 of housing 200. That portion of tubular member 248 extending from flange 264 to cable 242 forms an annular space 266 with the interior wall of housing 200. Flow ports 268 are provided in tubular member 248 to communicate bore 254 with annular space 266 and thus lower borehole annulus 34 via flow ports 72 in housing 200. Flow ports 268 are located adjacent flow ports 72 upon the engagement of flange 264 and shoulder 232.

Tubular member 248 also includes an inwardly directed annular shoulder 270 for engaging an annular ring 272 on shaft 242 on one side and for providing a bearing surface for spring 246 on the other side.

Retainer ring 252 threadingly engages threads 234 of housing 200 to hold flange 264 of tubular member 248 against shoulder 232 of housing 200, thus securing member 248 within housing 200. Ring 252 has a coaxial bore slidably receiving that end of shaft 242 attached to cable 142. Ring 252 also has vertical flow apertures 274 therethrough to provide fluid communication between those portions of bore 236 above and below ring 252.

Spring 246 is inserted into bore 254 against shoulder 270 and receives that end of shaft 242 connected to firing pin 244. Firing pin 244 is provided with a face 276 towards spring 246 to capture spring 246 between face 276 and shoulder 270.

Figure 6:
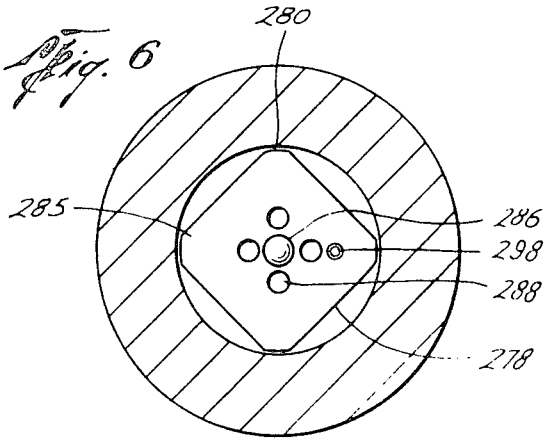
FIG. 6 is a cross-sectional view of the firing mechanism taken at plane 6—6 shown in FIG. 3.

Firing pin 244 includes a generally rectangular body 278 with truncated corners 280 as shown in FIG. 6. A coaxial blind bore 282 is provided in body 278 for receiving one end of shaft 242. Horizontal channels 284 are provided past corners 280 and vertical channels 285 are provided around corners 280. A point 286 extends downwardly from the lower face of body 278 for passing through entrance 224 to impact initiator 220. A plurality of flow ports 288 pass through the bottom of blind bore 282 to communicate with flow port 290 extending from the end of shaft 242 to a point above the upper face 276 of body 278. The end of shaft 242 has an annular stop shoulder 292 engaging upper face 276 to limit the insertion of shaft 242 into blind hole 282 and insure a clearance 294 between the end of shaft 242 and bottom of blind bore 282 for fluid flow.

Shear connection 250 includes one or more shear pins 296 extending through a hole in firing pin body 278 and into a blind hole in the end of shaft 242. A securement pin 298 installed in a vertical hole in body 278 prevents shear pin 296 from backing out of engagement with shaft 242.

The interior of firing mechanism 80 is pressure balanced with the lower borehole annulus pressure. This pressure equalization is permitted by flow ports 72 in housing 200, flow ports 268 in tubular member 248, flow apertures 274 in retainer ring 252, flow ports 288 and horizontal and vertical channels 284, 285 in firing pin 244, flow port 290 in the end of shaft 242, and clearance 294 between shaft 242 and firing pin 244. These permit the free flow of fluid within housing 200 above initiator 220 such that firing mechanism 80 is pressure balanced. Further, these flow ports and channels permit the uninhibited reciprocation of shaft 242 and firing pin 244 within housing 200 during cocking and detonation.

Shaft 242 includes a hydraulic connection 243 above annular ring 272 for safety. Connection 243 includes a pin piston 245 at the end of that part of shaft 242 connected to cable 142 and a pin cylinder 247 at the end of that part of shaft 242 connected to firing pin 244. Pin piston 245 is telescopingly received by pin cylinder 247 and is sealingly engaged therewith by O-ring seals 249 housed in annular grooves in the outer periphery of pin piston 245. Pin piston 245 forms an annular shoulder 251 with the remainder of shaft 242 to limit the entry of pin piston 245 within pin cylinder 247. Pin piston 245 has a length less than the depth of pin cylinder 247 to create an atmospheric chamber 253 in the bottom of pin cylinder 247. Since the external pressure, i.e. lower annulus pressure, around shaft 242 will be substantially greater than the atmospheric pressure in chamber 253, connection 243 will remain secure. However, once firing mechanism 80 is raised to the surface 12, the external pressure around shaft 242 will also be at atmospheric pressure causing connection 243 to disengage and disarm perforating gun 50.

Except under certain conditions such as for example in shallow wells, packer 30 is used to isolate the hydrostatic in upper annulus 32 from the lower annulus 34, for the perforation of formation 14. Once valve 60 is opened to release the trapped pressure below the packer 30, the pressure in the tubing 26 and lower annulus 34 equalizes. At this time two separate pressure systems have been created, namely the 32 upper annulus pressure and the 34 lower annulus pressure. Since the lower annulus pressure determines whether there is an underbalance or over-balance on the formation, i.e. lower annulus pressure is less or more than the formation pressure of formation 14, it is particularly useful to utilize the annulus pressure system to actuate the detonation of the perforating gun 50. By using upper annulus pressure, no pressurization of the tubing flow bore 40 or lower annulus 34 is required nor is it necessary to mechanically detonate the gun by passing a bar through all of the test equipment, including valve 60 which would have to be fully open to permit the passage therethrough of the bar. Thus it is a principle object of the present invention to activate the detonation of gun 50 using the upper wellbore annulus 32 rather than either the tubing flow bore 40 or lower borehole pressure annulus 34. In summary, the present invention initiates the detonation of gun 50 through the pressurization of the fluids in upper annulus 32 to open the valve 60 and then utilize the pressure differential across the packer 30 for transmission to the gun 50 located in the lower annulus 34.

OPERATION OF EMBODIMENT OF FIGS. 2–6

In utilizing the apparatus shown in FIGS. 2–6 to carry out the method of the present invention in testing formation 14, the present invention is assembled and armed by making up pressure responsive means 70 and firing mechanism 80 on pipe string 64 without cable 142. The tool string is then lowered into tubing string 26 until pressure responsive means 70 is in position on rig 18. The cable 142 is attached to pressure responsive means 70 and is lowered through pipe string 64 with a weight until it reaches firing mechanism 80. The tool string is then raised until firing mechanism 80 is in position on rig 18 and cable 142 is connected to firing mechanism 80 via access port 228.

The tool string as shown in FIG. 1 is then lowered into borehole 10. Although flow ports 72 permit the well fluids in wellbore 24 to flow into that portion 56 of flow bore 40 of tubing string 26 extending below valve 60, valve 60 is closed thereby preventing the well fluids from flowing further up the tubing flow bore 40 above valve 60 indicated at 58.

There will be free access between the wellbore annulus 28 and tubing flow bore 40 around piston means 76 due to flow ports 72 as the tool string is lowered into the well providing a U-tube effect on piston means 76. Thus, with respect to pressure responsive means 70, the pressures across piston sleeve 116 are equal. Until packer 30 is set and valve 60 is opened, the pressures on the upper and lower ends of piston sleeve 116 will remain the same and prevent any cocking of firing pin 244. There is, however, a pressure differential across valve 60.

The hydrostatic head of well fluids in wellbore annulus 28 is greater than the formation pressure to control the well until the setting of packer 30. If the hydrostatic head in tubing string 26 were to be greater than the formation pressure at the time of perforation, well fluids in lower annulus 34 would tend to flow into the formation 14, i.e. towards the lower pressure. Therefore, it is desirable to reduce the hydrostatic head in tubing string 26 to a predetermined pressure less than the formation pressure to obtain an underbalance or pressure differential towards the flow bore 40 of tubing string 26. Thus, the portion 58 of flow bore 40 above valve 60 may be substantially dry or may include a predetermined column of fluid such as water, diesel, or light crude. By maximizing the underbalance using a jet type casing perforator gun, deeply penetrating perforations are provided with an immediate cleanup due to high backsurge pressures resulting in maximum hydrocarbon flow from formation 14. Perforating with high differential pressure toward lower annulus 34 backsurges the perforations 44 and tunnels 46 to flush out debris and compaction caused by the cementing and perforating operations.

Once perforating gun 50 is adjacent formation 14, a logging tool is run down tubing string 26 to valve 60 to insure that gun 50 is properly positioned with respect to formation 14. At that time, packer 30 is set, dividing borehole annulus 28 into upper annulus 32 and lower annulus 34. Upon setting packer 30, the lower annulus pressure caused by the hydrostatic head in wellbore annulus 28 is trapped beneath packer 30 and valve 60.

One method taught by the prior art is to simultaneously open the dry tubing string at the time of perforation. See U.S. Pat. No. 2,906,339. Such a procedure has severe shortcomings. If the trapped bottomhole pressure is released suddenly at the time of perforation, a sudden pressure differential is created across casing 16 adjacent formation 14 as the trapped bottomhole pressure and formation fluids rush to the surface through the tubing string 26. This sudden pressure release causes a shock wave amounting to a kinetic force moving from the formation to the surface. Since the perforations through the casing are not large enough to take this shock force, the casing will, in many instances, collapse, ruining the well. Further, the shock wave will tend to move packer 30 thereby causing the packer to lose its seal. Thus, a blowout could occur.

The preferred method is to vent the trapped bottomhole pressure below packer 30 prior to perforation. This release of the trapped bottomhole pressure permits the stresses, such as stress risers, in casing 16 to flow and distribute, creating a static pressure differential across the casing rather than a dynamic pressure differential. Thus, the formation pressure becomes a static force around casing 16 rather than a dynamic force. By venting the trapped bottomhole pressure, the bottom-hole pressure becomes substantially the same as the pressure in tubing flow bore 40, creating a large static pressure across the casing. Upon perforation, the formation pressure is all vented through the perforations, permitting an enhanced backsurging.

To relieve the trapped pressure, pump pressure is applied to the well fluids in upper annulus 32 causing a pressure differential between upper annulus 32 and the pressure trapped below valve 60. This pressure differential opens valve 60 but is insufficient to shear pins 138 of piston sleeve 116. Therefore, piston sleeve 116 does not move. The opening of valve 60 relieves the pressure which was trapped in lower annulus 34, and the pressure of portion 58 of tubing flow bore 40 equalizes with the pressure of portion 56 of tubing flow bore 40 and lower annulus 34.

Until a pressure differential is created across piston sleeve 116, piston sleeve 116 cannot move upwardly in annular space 118 of pressure responsive means 70 since the upper annulus pressure equals the lower annulus pressure and thus there is no pressure differential across piston means 76. However, once valve 60 is opened, the lower annulus pressure no longer equals the upper annulus pressure and a pressure differential is created across piston sleeve 116. Shear pins 138 require that pressure in upper annulus 32 be further increased to shear pins 138 securing piston sleeve 116. Shear pins 138 may, of course, be sized to shear at a variety of pressure differentials. After shear pins 138 are sheared, the pressure differential between upper annulus 32 and tubing flow bore 40 causes piston sleeve 116 to travel upwardly in annular space 118 as the upper annulus pressure acts on end 132 of piston sleeve 116 via pressure chamber 74 and flow ports 140.

Shear pins 138 cause piston sleeve 116 to begin upward travel at a predetermined and known pressure differential across piston means 76. This is often desirable, for example, for detection purposes or for packer testing.

It may be desirable to test packer 30 after valve 60 is opened and before gun 50 is detonated. By pinning the piston sleeve 116 with shear pins 138 set to shear at a pressure differential greater than that required to open valve 60 and test packer 30, this packer test can easily be accomplished. However, even if during the testing of packer 30 upper annulus 32 is pressurized and gun 50 detonates, packer 30 must have held since otherwise gun 50 could not have been fired. It is necessary for packer 30 to hold the annulus pressure to permit sufficient pressure actuation of piston sleeve 116 to cock and release firing head 244.

The opening of valve 60 may be detected at the surface due to the pressure flux caused by the relief of the pressure trapped below valve 60. Further, another pressure flux is detected at the surface upon the detonation of gun 50. If the fluid pressure is not permitted to normalize after the opening of valve 60, the detonation of gun 50 may not be detected. Thus it may be preferred that there is a time delay between the opening of valve 60 and the detonation of gun 50 to permit the fluid pressures to normalize. This is insured by pinning piston sleeve 116 in the pressure responsive means 70. For example, shear pins 138 may be set to shear at a pressure differential 1,000 psi greater than the pressure required to open valve 60. Thus to detonate after valve 60 is opened, an additional 1,000 psi annulus pressure would be required to shear pins 138 and permit piston sleeve 116 to travel upwardly to detonate gun 50 as hereinafter described.

However, it should be clear that although shear pins 138 are preferred, shear pins 138 may be unnecessary in certain situations and therefore be eliminated.

As piston sleeve 116 moves upwardly within annular space 118, piston sleeve 116 puts tension on cable 142 causing shaft 242 to travel upwardly with firing pin 244. This upward movement compresses spring 246 between shoulder 270 and face 276 of firing pin 244. After face 276 of firing pin 244 engages the lower end 298 of tubular member 248, further upward travel of firing pin 244 is prevented. Once the force of cable 142 on shaft 242 exceeds the yield strength of shear pins 296, pins 296 will shear and sever shear connection 250.

Upon releasing firing pin 244, spring 246 propels firing pin 244 on shaft 242 downwardly, impacting initiator 220 whereupon the shaped charges 52 of gun 50 are detonated and the casing 16 perforated. Deeply-penetrating perforations 44 and tunnels 46 are formed in formation 14, reaching sterile zone 54 and immediate backsurge and cleanup occurs with high backsurge pressures and maximum hydrocarbon flow with the high pressure differential towards tubing flow bore 40. The perforating forms a flow path along which hydrocarbons from formation 14 can then flow through perforations 44 and tunnels 46, into the lower annulus 34, uphole through flow ports 72 into tubing flow bore 40, and to the outlet 38 where the production is gathered in the usual manner.

If the operator should decide not to perforate and complete the well, valve 60 is closed by bleeding the pressure in upper annulus 32, and packer 30 is unseated. After the packer 30 is unseated, the pressures across piston sleeve 116 are equalized thus eliminating cable tension and disarming firing mechanism 80. Spring 160 above piston sleeve 116 moves piston sleeve 116 downwardly in annular space 118 until shoulders 136 engage. This downward movement puts slack in cable 142. When access port 228 in housing 200 comes to the surface 12, cable 142 is disconnected at connection 256 from shaft 242 and firing mechanism 80 is removed. Gun 50 is then brought above ground.

As gun 50 is removed from borehole 10, firing mechanism 80 cannot be cocked, so as to fire the gun. The only way that piston means 76 could be in a cocked position is if it hangs up within annular space 118. However, there is nothing in annular space 118 for piston means 76 to hang on. Further, piston means 76 is never mechanically held in the cocked position. Only if piston means 76 travels upwardly a sufficient distance to shear pins 296 will it detonate. Thus, holding piston means 76 in a partial travel up annular space 118 will not permit pins 296 to shear and detonate gun 50.

Although non-bar actuation of perforating gun 50 for the testing of formation 14 is preferred, a bar actuated firing head such as disclosed in U.S. Pat. Nos. 3,706,344 to Vann and U.S. Pat. No. 4,299,287 to Vann et al, incorporated herein by reference, may be used where all formation test tools are fully opening to permit the passage of the bar therethrough. The problem of settled and congealed mud and debris may be overcome using apparatus as described in U.S. patent application Ser. No. 383,746 filed June 1, 1982 entitled "Well Cleanup and Completion Apparatus"; U.S. patent application Ser. No. 384,508 filed June 3, 1982 entitled "Gun Below Packer Completion Tool String"; U.S. patent application Ser. No. 385,707 filed June 7, 1982 entitled "Gun Firing System Using Fluid Filled Pressure Balance Tube"; or U.S. patent application Ser. No. 385,708 filed June 7, 1982 entitled "Well Completion and Clean-Out", all incorporated herein by reference. These applications disclose various methods and apparatus for cleaning and/or protecting the firing head from mud and debris. One such apparatus includes disposing a frangible disc between the firing head and circulation flow ports through the tubing string.

In operation with a bar actuated firing head, a tool string is suspended within the well comprising fully opening test tools including a fully opening valve (such as the APR valve previously described), a packer, a perforated sub with flow ports, a frangible disc, a bar-actuated firing head, and a casing type perforating gun. The packer is set and a bar is dropped down the drill string. The bar passes through the fully opened valve and other test tools, breaks the frangible disc, and impacts the firing head to detonate the perforating gun. The casing 16 and formation 14 are perforated for the hydrocarbons to flow into lower annulus 34, through the flow ports of the sub, and up tubing flow bore 40 to the surface.

Although the apparatus of FIGS. 2–6 has been described in detail with respect to formation testing, the apparatus may also be used in other methods such as well completions. The following is a further discussion of the present apparatus and its use for well completions. Where the designations of FIGS. 1–6 are identical to or substantially the same as that described with respect to the following well completion methods, the same names and numerals will be used.

Figure 7:
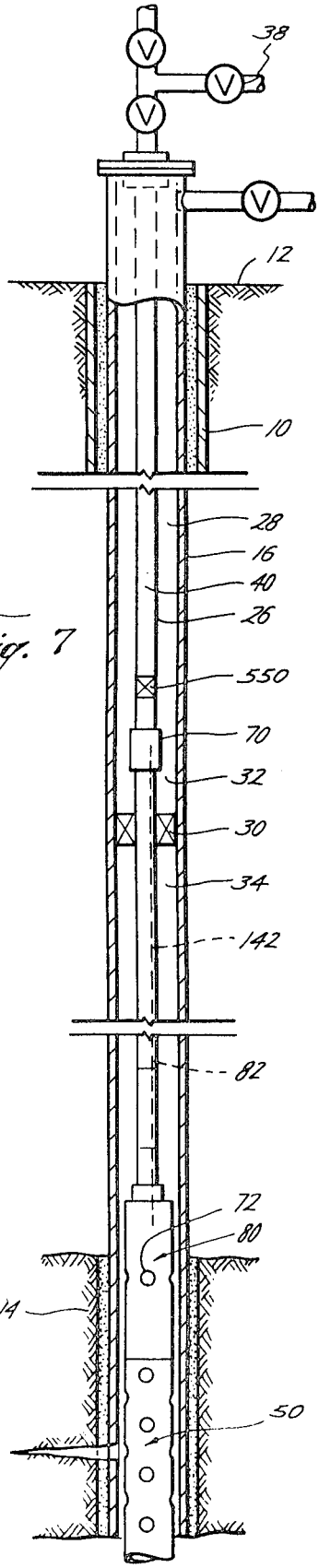
FIG. 7 is a fragmentary, part cross-sectional view of a borehole having apparatus made in accordance with the present invention for completing a well.

Referring now to FIG. 7, there is shown the borehole 10 of FIG. 1 with casing 16 passing through formation 14 to be completed. The tool string includes tubing string 26, pressure responsive means 70, packer 30, tubing valve means 550, flow ports 72, firing mechanism 80, and perforating gun 50. Pressure responsive means 70 includes force transmission means 82, such as cable 142, extending from pressure responsive means 70 to firing mechanism 80. Tubing valve means 550 is preferably disposed in tubing string 26 above pressure responsive means 70 to avoid passing cable 142 through tubing valve means 550. Where tubing valve means 550 is disposed above pressure responsive means 70, and since pressure responsive means 70 is located above packer 30, the described tool string requires that tubing valve means 550 also be located above packer 30. However, it should be understood that tubing valve means 550 may be located adjacent flow ports 72 and below packer 30 where tubing valve means 550 is provided with means for passing force transmission means 82 from pressure responsive means 70, through tubing valve means 82, to firing mechanism 80.

Tubing valve means 550 may include the commercial valves described with respect to valve 60 of the preferred embodiment and be actuated by hydraulic pressure, rotation or reciprocation. Hydraulically actuated valves are actuated by increasing the annulus pressure in upper annulus 32. However, tubing valve means 550 might also include a blanking plug set in a profile disposed in tubing string 26 whereby the blanking plug is removed to create the pressure differential across the piston means 76 of pressure responsive means 70. Other suitable tubing valve means 550 may be devised by those skilled in the art.

In the operation of the method disclosed in FIG. 7 for the completion of formation 14, the tool string as described is assembled and lowered into the cased borehole with well fluids flowing through flow ports 72 and up into flow bore 40 to tubing valve means 550. A predetermined level of fluid is placed in tubing string 26 above tubing valve means 550 to achieve the desired underbalance upon perforation.

Once perforating gun 50 is properly positioned adjacent formation 14, packer 30 is set to divide the borehole annulus 28 into upper annulus 32 and lower annulus 34. The piston means 76 of pressure responsive means 70 cannot travel upwardly until tubing valve means 550 is opened. Tubing valve means 550 is then opened to relieve the trapped pressure in lower annulus 34 and tubing flow bore 40 below valve means 550 and to cause the pressure differential across the piston means 76 of pressure responsive means 70. Once tubing valve means 550 is opened, the piston means 76 of pressure responsive means 70 reciprocates, force is transmitted through cable 142 to firing mechanism 80 to move the shaft 242 and firing pin 244 of firing mechanism 80 upwardly and compress the spring 246. Once the firing pin 244 is prevented from further upward movement, a further upward force will cause the shear pins 296 to shear. The firing head is then propelled downwardly to impact the initiator 220 of gun 50 to detonate the shaped charges 52 thereof. Hydrocarbons then flow through the perforations into flow ports 72 and up through open tubing valve means 550 to the surface.

It is also envisioned that the method and apparatus of the present invention may be accomplished without a tubing valve means. For example, the tool string described with respect to FIG. 6, with the exception of tubing valve means 550, may be lowered into the well with the well fluids flowing through flow ports 72 to create a hydrostatic head within tubing flow bore 40 equal to the hydrostatic head in wellbore annulus 28. Since the hydrostatic heads are equal, there is no pressure differential across the piston means 76 of pressure responsive means 70.

Prior to setting packer 30, the well fluids within tubing flow bore 40 may be displaced by pumping nitrogen down tubing flow bore 40 to circulate the well fluids out of bore 40 and through flow ports 72 and up wellbore annulus 28. Pump pressure is maintained on tubing flow bore 40 to insure pressure equalization between tubing flow bore 40 and wellbore annulus 28.

Packer 30 may then be set and the nitrogen in tubing flow bore 40 bled off, creating a differential pressure across the piston means 76 of pressure responsive means 70. Upon reaching the desired differential pressure, the piston means 76 in pressure responsive means 70 will have travelled sufficiently to activate firing mechanism 80 and shear the shear connection 250 to detonate gun 50.

In either of the two above descriptions with respect to FIG. 7, piston means 76 of pressure responsive means 70 may include shear pins 138 to permit the travel of the piston sleeve at a preset differential pressure across the piston means 76 of pressure responsive means 70. Also, in both of the above methods, the desirable underbalance may be established to create the desirable backsurge on the perforation.

EMBODIMENTS OF FIGS. 8-10

Figure 10:
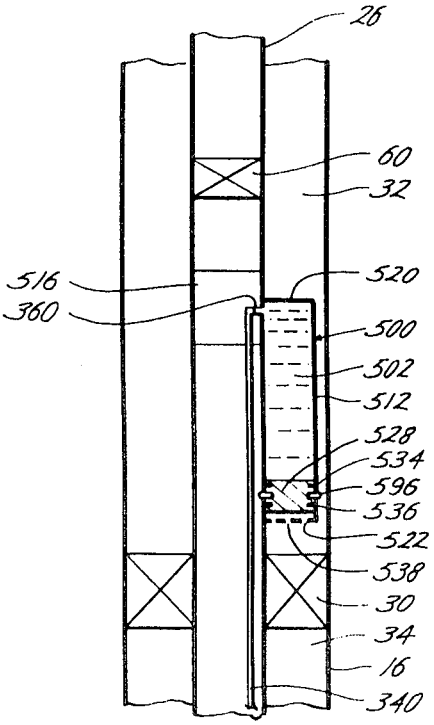
FIG. 10 is an enlarged, cross-sectional view of another embodiment of the pressure responsive means shown in FIG. 8.
Figure 8:
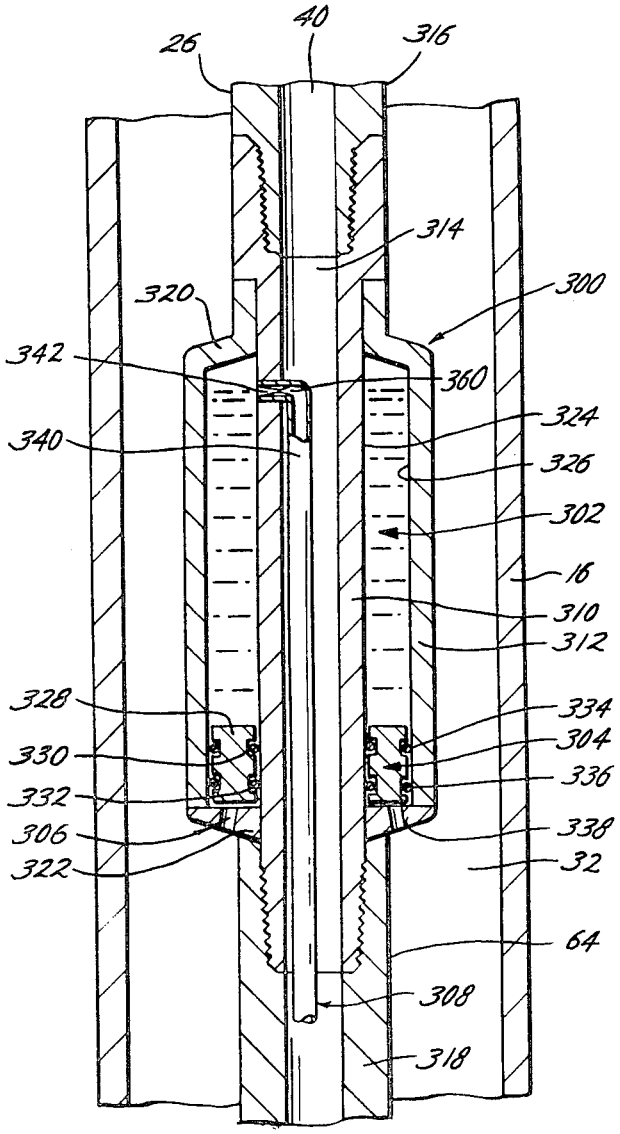
FIG. 8 is an enlarged cross-sectional view of another embodiment of the pressure responsive means of the apparatus shown in FIGS. 1 and 7.
Figure 9:
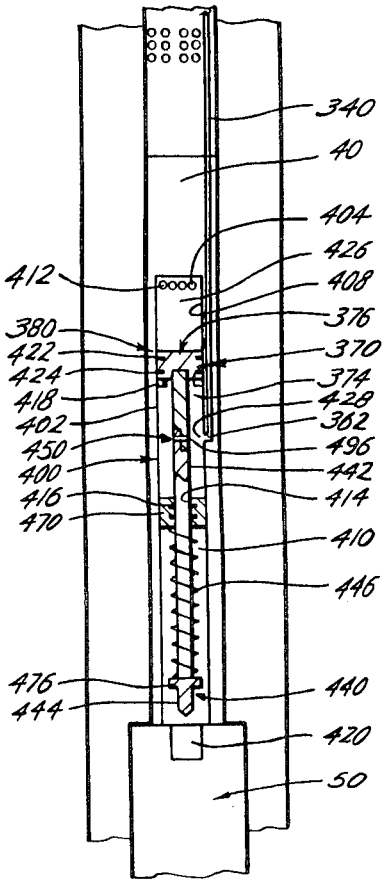
FIG. 9 is an enlarged cross-sectional view of another embodiment of the firing mechanism for the apparatus shown in FIGS. 1 and 7.

While FIGS. 2-7 illustrate one embodiment of the apparatus of the present invention, other embodiments of the apparatus are shown in FIGS. 8, 9 and 10. Referring now to FIGS. 8 and 9, FIG. 8 depicts another embodiment of the apparatus of the present invention. This embodiment includes an upper pressure responsive means 300 which is series connected in tubing string 26 above packer 30 of FIG. 1. Upper pressure responsive means 300 would be located at the same location as pressure responsive means 70 shown in FIG. 1. Upper pressure responsive means 300 includes an annular chamber 302, piston means 304, pressure communication means 306 and force transmission means 308.

Annular chamber 302 is formed by inner tubular member or mandrel 310 and outer tubular member or cylinder 312 for containing an incompressible fluid such as oil. Mandrel 310 is a generally cylindrical member having a flow passageway 314 extending axially therethrough and forming a portion of tubing flow bore 40 shown in FIG. 1. Means for making rotary shouldered connections with adjacent drill pipe members 316, 318 of pipe string 64 are provided at the upper and lower ends of mandrel 310.

Outer tubular member or cylinder 312 includes an upper inwardly directed annular flange 320 and a lower closure disk 322. Flange 320 and disk 322 have coaxial bores for receiving mandrel 310. Mandrel 310 and cylinder 312 form the inner and outer tubular walls 324, 326 respectively, of the chamber 302, and flange 320 and disk 322 form the upper and lower closure members for chamber 302. Flange 312 and disk 322 are sealingly attached to mandrel 310 and cylinder 312 to create a fluid tight chamber.

Piston means 304 includes an annular piston sleeve 328 having a bore therethrough. Piston sleeve 328 has an inner and outer diameter sized to permit piston sleeve 328 to be slidingly received within annular chamber 302. Inner O-rings 330, 332 are disposed in annular grooves on the inner periphery of piston sleeve 328 to sealingly engage exterior wall 324 of mandrel 310, and outer O-rings 334, 336 are disposed in annular grooves on the outer periphery of piston sleeve 328 to sealingly engage the interior wall 326 of cylinder 312. Piston sleeve 328 divides chamber 300 into upper and lower portions which expand and contract upon the reciprocation of piston sleeve 328 within chamber 300.

Pressure communication means 306 includes a plurality of ports 338 passing through disk 322 providing fluid communication between upper borehole annulus 32 and that portion of chamber 302 below piston sleeve 328. Oil fills that portion of chamber 302 above piston sleeve 328. Ports 338 have been located in the downhole end of chamber 302 to prevent any debris in borehole annulus 32 from settling into chamber 302. A screen may be provided over ports 338 to filter any large particulate material and prevent such material from passing into chamber 302.

Force transmission means 308 includes a conduit 340 extending from upper pressure responsive means 300 to lower pressure responsive means 370 of firing mechanism 380 shown in FIG. 9. Conduit 340 is sealingly attached by suitable high-pressure connections at the outlet of aperture 342 extending through mandrel 310 between that portion of chamber 302 above piston 328 and passageway 314 of mandrel 310. The oil in chamber 302 is displaced from upper pressure responsive means 300 to lower pressure responsive means 370 via conduit 340. Conduit 340 is a stainless steel tube which will not bend easily and has a small diameter such as one quarter inch, as compared to the internal diameter of passageway 314 of mandrel 310 so as not to restrict flow through tubing flow bore 40. A coating, such as Teflon made by Du Pont, may be applied to the exterior surface of conduit 340 to protect the conduit in particularly corrosive well environments.

Referring now to FIG. 9, gun firing mechanism 380 includes a cylindrical housing 400, a lower pressure responsive means 370 and detonator means 440. Housing 400 is an upstanding cylinder 402 threadingly provided with a closure cap 404 at its upper end and threadingly secured at its lower end to the top of perforating gun 50. Housing 400 extends upwardly within tubing string 26 and has seal means for sealing housing 400 with gun 50. Although gun firing mechanism 380 is illustrated mounted above gun 50, gun firing mechanism could also be disposed below gun 50. Barrier means 470 in the form of an annular cylindrical member is received and affixed to cylindrical housing 400 to divide housing 400 into an upper cylinder 408 and a lower chamber 410. Radial ports 412 are provided in the upper end of housing 400 adjacent cap 404 to provide communication between upper cylinder 408 and tubing flow bore 40. Upper cylinder 408 has a polished bore.

Detonator means 440 includes a shaft 442 having a firing pin 444 affixed to its lower end and disposed in lower chamber 410. Firing pin 444 is provided with an annular shoulder 476 and a downwardly projecting point for engaging the initiator 420 of gun 50. A coiled spring 446 telescopingly receives shaft 442 and bears against annular shoulder 476. Barrier means 470 has a central bore 414 reciprocally receiving shaft 442 with spring 446 being captured between barrier means 470 and shoulder 476. O-ring seals 416 are housed within annular grooves in barrier means 470 for sealingly engaging shaft 442 as it reciprocates in bore 414. Thus, lower chamber 410 is sealed from upper cylinder 408.

Lower pressure responsive means 370 includes a piston means 376 attached to the upper end of shaft 442 above barrier means 470 and slidingly received within upper cylinder 408. Stop means 418 is disposed within cylinder 408 and below piston means 376 to limit the downward travel of piston means 376 within cylinder 408 thus preventing any premature detonation of gun 50 caused by an unplanned application of pressure on the top of piston means 376 pressing down on piston means 376, shaft 442 and firing pin 444.

Shaft 442 includes a shear connection 450 with shaft 442 being severed at the connection and pinned together by shear pins 496. The severed ends of shaft 442 are dovetailed together with pins 496 being received by aligned holes through the severed ends. The shear value of shear pins 496 permits much flexibility in the design of the lower pressure responsive means 370 and detonator means 450.

The sizing of piston sleeve 376, the compression in spring 446, and the yield strength of shear pins 496, all permit flexibility in designing the system for a particular well environment whereby, for example, the temperature of the borehole may be taken into account as it affects the fluid in chamber 302 shown in FIG. 8.

Piston means 376 includes seal means, such as O-rings 422, 424 housed in annular grooves in piston means 376, for sealingly engaging the interior wall of upper cylinder 408. Piston means 376 divides upper cylinder 408 to form pressure chamber 374 in the lower portion of cylinder 408 and a ported chamber 426 in the upper portion. Ported chamber 426 includes that portion of cylinder 408 above piston means 376 and is communicated with tubing flow bore 40 by means of apertures 412 adjacent closure cap 404. Ported chamber 426 is filled with grease to prevent the well fluids in flow bore 40 from filling chamber 426 and depositing solids on piston means 376. A screen may be provided over apertures 412 to prevent any debris from clogging the apertures. Apertures 412 are disposed radially to inhibit the entry of material settling from the well fluids down through flow bore 40.

Referring now to both FIGS. 8 and 9, conduit 340 extending down from upper pressure responsive means 300, possibly several hundred feet, is sealingly connected to an aperture 428 extending through the wall of housing 400 between stop means 418 and barrier means 470, i.e. pressure chamber 374, by a high pressure quick connect. The sealability of the quick connects for conduit 340 is not critical since there will be no pressure differential across piston sleeve 328 and piston means 376 prior to activation. Generally, the pressure on the outside of conduit 340 and its connections will be greater than the pressure within conduit 340 so that the tendency will be for leakage into the conduit 340 rather than out of the conduit.

Upper and lower chokes 360, 362 are provided at aperture 342 of upper pressure responsive means 300 and at aperture 428 of lower pressure responsive means 370 of firing mechanism 380, respectively, to prevent any sudden fluid surges through conduit 340 due to sudden extreme pressure differentials and variations between flow bore 40 and upper annulus 32 applied across piston sleeve 328 and piston means 376. Further, chamber 302, conduit 340, and pressure chamber 374 are all completely filled with oil and no air is present. Any incompressible fluid in these would require a longer travel of piston sleeve 328 to move piston means 376 for the actuation of firing pin 444.

Another embodiment of the upper pressure responsive means 300 of FIG. 8 is illustrated in FIG. 10. Common numerals are used in FIG. 10 to the extent the apparatus is the same as previously described with respect to FIGS. 1, 8 and 9. Upper pressure responsive means 500, shown in FIG. 10, differs from the previously described upper pressure responsive means 300 in FIG. 8 principally in that upper pressure responsive means 500 is not series connected with tubing string 26 but is disposed on the exterior of tubing string 26, i.e. means 300 is integral with string 26 and means 500 is offset.

Upper pressure responsive means 500 includes a cylinder 512 having a piston 528 reciprocally mounted within chamber 502 formed by cylinder 512. Cylinder 512 is closed at its ends by upper and lower closure members 520, 522, respectively. Lower closure member 522 includes pressure communication means in the form of of apertures 538. Apertures 538 face downwardly to avoid any particulate material settling on piston 528. Piston 528 divides chamber 502 into an upper reservoir filled with oil and a lower area subject to the upper annulus pressure due to apertures 538. O-rings 534, 536 housed in annular grooves in piston 538 sealingly engage the interior wall of cylinder 512. Force transmission means 308 in the form of conduit 340 communicates the reservoir of chamber 502 with pressure chamber 374 of lower pressure responsive means 370 of firing mechanism 380 shown in FIG. 9. Cylinder 512 is attached by suitable means to a sub 516 series connected in tubing string 26.

Piston 538 is shown releasably connected to cylinder 512 by shear pins 596. Shear pins 596 may be preferred in certain situations since pins 596 insure that piston 538 will not travel upwardly within cylinder 512 until there is a predetermined pressure differential across piston 538 and piston means 376. Shear pins are not essential to upper pressure responsive means 500 but are shown as a possible variation that could also be used with pressure responsive means 300.

Pressure responsive means 500 operates the same as pressure responsive means 300 and means 300,500 differ principally in their location with respect to tubing string 26. Operators often prefer for all tools in the tool string to have drill pipe strength if series connected with other drill pipe. Thus, it is preferred that the pressure responsive means be made out of drill pipe material and series connected rather than be suspended in the upper annulus 32 where it might hang up and be damaged. Further, there are often space limitations in the wellbore annulus prohibiting the location of pressure responsive means 500 in the annulus.

Although not preferred, the pressure responsive means of the present invention may electrically detonate perforating gun 50 rather than use hydraulic actuation. The pressure responsive means for electrical detonation would include electric conduit means for the force transmissions means rather than the cable 142 and conduit 340 shown in FIGS. 2 and 8, respectively. The pressure responsive means would include a battery pack and two electric leads extending to the gun whereby as the piston in the pressure responsive means traveled upwardly, two electrodes would be engaged and an electric circuit completed to an electrically actuated firing pin to detonate the gun.

While various embodiments of the upper pressure responsive means have been shown and described, modifications thereof can be made by one skilled in the art without departing from the spirit of the invention.

OPERATION OF THE EMBODIMENTS OF FIGS. 8–10

In carrying out the method of the present invention to test formation 14 using the embodiments disclosed in FIGS. 8, 9 and 10, the tool string as shown in FIG. 1 is assembled and lowered into borehole 10. Although flow ports 72 permit the well fluids in the wellbore 24 to flow into that portion 56 of flow bore 40 of tubing string 26 extending below valve 60, valve 60 is closed thereby preventing the well fluids from flowing further up the tubing flow bore 40 above valve 60 as indicated at 58.

There will be free access between the wellbore annulus 28 and tubing flow bore 40 above piston means 370 due to flow ports 72 as the tool string is lowered into the well providing a U-tube effect on piston sleeve 328 and piston means 376. Until packer 30 is set and valve 60 is opened, the pressures on the upper side of piston means 376 and the lower side of piston sleeve 328 (piston sleeve 528 in FIG. 10) will remain substantially the same and prevent any cocking of firing pin 444.

Once perforating gun 50 is adjacent formation 14, a logging tool is run down tubing string 26 to valve 60 to insure that gun 50 is properly positioned with respect to formation 14. At that time, packer 30 is set, dividing borehole annulus 28 into upper annulus 32 and lower annulus 34. Upon setting packer 30, the lower annulus pressure caused by the hydrostatic head in wellbore annulus 28 is trapped beneath packer 30 and valve 60.

To relieve the trapped pressure, pump pressure is applied to the well fluids in upper annulus 32 to open valve 60. The opening of valve 60 relieves the pressure which was trapped in lower annulus 34, and the pressure of tubing flow bore 40 and lower annulus 34 equalize.

Until valve 60 is opened, piston sleeve 328 cannot move upwardly in chamber 302 of pressure responsive means 300 since the upper annulus pressure equals the lower annulus pressure on piston means 376 in cylinder 408 of lower pressure responsive means 370. However, once valve 60 is opened, the lower annulus pressure no longer equals the upper annulus pressure and a pressure differential is created across piston means 376 and piston sleeve 328 (piston sleeve 528 in FIG. 10). Since the pressure in upper annulus 32 will be greater than the pressure in tubing flow bore 40 and lower annulus 34, piston sleeve 328 will travel upwardly in chamber 302 (piston sleeve 528 will travel upwardly in chamber 502 with respect to FIG. 10). The upward travel of piston sleeve 328 displaces oil through conduit 340 and into pressure chamber 374 in lower pressure responsive means 370 of firing mechanism 380. This displacement of oil causes piston means 376 in cylinder 408 to travel upwardly displacing the grease in chamber 426 out ports 412 and into tubing flow bore 40. Piston means 376 moves upwardly in cylinder 408 much like the movement of a hydraulic jack, i.e., slowly and at an even rate.

Where for some reason an instant differential pressure is prematurely caused across piston sleeve 328 (piston sleeve 528 in FIG. 10) and piston means 376, chokes 360 and 362 prevent any surge of oil through conduit 340 so as to activate lower pressure responsive means 370. Several seconds are required to pressure up piston sleeve 328 and fire gun 50. Chokes 360, 362 hold back any instant pressure differential until the differential pressure becomes normalized. Since several seconds of steady pressurization are required to pressure up pressure chamber 374, chokes 360, 362 prevent sufficient pressure time to detonate the gun.

If packer 30 should fail after the upper annulus 32 has been pressurized, piston means 376 will merely move back against stops 418 and will not permit the firing of gun 50.

As piston means 376 moves upwardly within cylinder 408, firing pin 444 travels upwardly with shaft 442 thereby compressing spring 446 between shoulder 476 and barrier means 470. The force required to continue such upward movement increases with the upward travel of piston means 376. Since the compression of spring 446 requires increased force for additional compression. Once the force required to further compress spring 446 exceeds the yield strength of shear pins 496, pins 496 will shear and sever shaft 442 at connection 450.

Upon severing shaft 442, spring 446 propels firing pin 444 on shaft 442 downwardly impacting initiator 420 whereupon the shaped charges 52 of gun 50 are detonated and the casing 16 perforated.

As in the embodiment of FIGS. 2–6, if the operator should decide not to perforate and complete the well, the firing mechanism 80 cannot be cocked so as not to fire the gun as the gun 50 is removed from the borehole. Piston means 376 is never mechanically held in the cocked position. Further, partial travel of piston means 376 in cylinder 408 will not permit pins 496 to shear and detonate gun 50.

Referring now to the description of pressure responsive means 500 and shear pins 596 shown in FIG. 10, shear pins 596 pinning piston sleeve 528 within cylinder 502 may be desirable such as for detection purposes or for packer testing as has been previously discussed with respect to FIGS. 2–6.

Further, the embodiments of FIGS. 8–10 may also be used with the methods described with reference to FIG. 7. The only principal difference is that the embodiment of FIGS. 8–10 include an upper and lower responsive means with the force transmission means being disposed therebetween. The upper pressure responsive means 300, 500 are disposed above packer 30 and lower pressure responsive means 370 is disposed adjacent firing mechanism 380. Thus, the pressure differential is applied across the pistons of both the upper and lower pressure responsive means.

These and various other objects and advantages of the present invention will become readily apparent to those skilled in the art upon reading the detailed description and claims and by referring to the accompanying drawings. The above objects are attained in accordance with the present invention by the provision of the methods of completing and testing highly unconsolidated formations for use with apparatus fabricated in a manner substantially as described in the above abstract and summary.

While a preferred embodiment of the invention has been shown and described, modifications thereof can be made by one skilled in the art without departing from the spirit of the invention.

I claim:

1. A method for completing a well, comprising, suspending a pipe string within the well comprising a valve, a pressure responsive means, a packer below the valve and pressure responsive means, a firing mechanism having a signal transmission means extending to the pressure responsive means, and a perforating gun adjacent the formation to be tested;

closing the valve to prevent fluid flow through the flow bore of the pipe string;

setting the packer to form an upper annulus in which is disposed the valve and pressure responsive means and a lower annulus below the packer to isolate the formation;

pressuring the upper annulus to open the valve;

creating a pressure differential across the pressure responsive means to produce a signal;

transmitting said signal through the signal transmission means from the pressure responsive means to the firing mechanism;

actuating the firing mechanism in response to the signal;

detonating the perforating gun to perforate the formation; and flowing hydrocarbons from the formation through the perforations and up the flow bore of the pipe string to the surface.

2. An apparatus for completing a well having a cased borehole, comprising:

a pipe string suspended within the cased borehole;

a packer disposed on the pipe string for forming an upper annulus and a lower annulus;

a valve connected in the pipe string for preventing fluid flow through the flow bore of the pipe string when in the closed position;

pressure responsive means disposed on the pipe string, said valve and said pressure responsive means being disposed above said packer, said pressure responsive means being exposed to fluid pressure in the upper annulus;

perforations in the drill pipe located below the packer in the lower annulus to permit fluid flow between the lower annulus and the tubing flow bore;

a perforating gun suspended on the end of the pipe string;

a firing head disposed on said perforating gun;

said valve being operative when opened to produce a pressure differential across the pressure responsive means;

said pressure responsive means being operative when subjected to said pressure differential thereacross to produce a signal;

signal transmission means extending from said pressure responsive means to said firing head;

said signal transmission means transmitting said signal to said firing head to actuate said firing head and detonate said perforating gun.

3. Apparatus according to claim 2 wherein said signal transmission means includes a fluid pressure conduit extending from said pressure responsive means to said firing head.

4. The apparatus of claim 2 wherein said pressure responsive means includes an annular chamber having a piston member disposed therein, said chamber being in fluid communication with the flow bore on one side of said piston member and in fluid communication with the upper annulus on the other side of said piston member whereby a pressure differential between the upper annulus and the flowbore will cause said piston to reciprocate with said chamber.

5. The apparatus of claim 4 wherein said piston member moves upon the creation of said pressure differential, and said signal transmission means includes a force transmitting member attached to said piston member on one end and to said firing head in said perforating gun on the other end, said force transmitting member cocking said firing head as said piston member actuates said force transmitting member.

6. The apparatus of claim 2 wherein said pressure responsive means includes a first chamber having a first piston member disposed therein, said first chamber being in fluid communication with the upper annulus on one side of said first piston member;

said signal transmission means including a fluid pressure conduit extending from said first chamber on the other side of said first piston member to said firing head on said perforating gun;

said firing head including a second chamber having a second piston member disposed therein, said second chamber being in fluid communication with the flowbore on one side of said second piston member and said second chamber being in fluid communication with said fluid pressure conduit on the other side of said second second piston member; and said first piston member forcing fluid through said fluid pressure conduit upon the creation of said pressure differential, said second piston member reciprocating within said second chamber upon the application of said pressure differential, said firing head moving into a cocking position as said second piston member reciprocates in said second chamber in response to said pressure differential.

7. A method for completing a formation in a well, comprising:

suspending a pipe string within the well, the pipe string including a valve, a pressure responsive means, a packer disposed below the valve and pressure responsive means, a perforating gun adjacent the formation to be completed and a firing mechanism associated with the perforating gun;

extending a signal transmitting member through the pipe string from the pressure responsive means to the firing mechanism;

closing the valve to prevent fluid flow through the flowbore of the pipe string and form an upper and lower flowbore;

flowing well fluids into the lower flowbore of the pipe string whereby the fluid pressure in the lower flowbore equals the fluid pressure adjacent the pipe string;

setting the packer to isolate the formation and form an upper annulus in which is disposed the valve and pressure responsive means and a lower annulus in which is disposed the firing mechanism and perforating gun;

opening the valve;

pressuring the upper annulus to create a pressure differential across the pressure responsive means and effect a signal on the signal transmitting member;

transmitting the signal via the signal transmitting member to the firing mechanism;

actuating the firing mechanism by means of the signal;

detonating the perforating gun to perforate the formation; and flowing fluids from the formation through the perforations and up the flowbore of the pipe string to the surface.

8. The method of claim 7 wherein the step of pressuring the upper annulus includes reciprocating a. piston member in the pressure responsive means with respect to the pipe string and transmitting the signal to the firing mechanism as the piston member reciprocates.

9. The method of claim 7 wherein the step of actuating the firing mechanism includes transmitting the signal of the signal transmitting member to a firing pin on the firing mechanism;

cocking the firing pin;

releasing the firing pin; and engaging the initiator of the perforating gun with the firing pin.

10. The method of claim 7 further including after the step of opening the valve, the step of relieving the pressure trapped beneath the packer and valve.

11. The method of claim 10 further including after the step of relieving the trapped pressure, the step of causing a pressure differential across that portion of the casing adjacent the formation whereby the lower annulus pressure is less than the formation pressure.

12. The method of claim 7 further including after the step of opening the valve, the step of reducing the lower annulus pressure to a pressure less than the formation pressure.

13. The method of claim 7 further including after the step of detonating the perforating gun, the step of backsurging the perforations and tunnels caused by the perforating.

14. The method of claim 7 further including after the step of opening the valve, the step of equalizing the pressure in the upper flowbore of the pipe string with the lower annulus pressure.

15. The method of claim 7 wherein the step of creating a pressure differential across the pressure responsive means includes preventing the pressure responsive means from effecting a signal on the signal transmitting member until a predetermined pressure differential is achieved.

16. The method of claim 7 further including after the step of opening the valve, the step of testing the packer.

17. The method of claim 7 further including after the step of opening the valve, the step of detecting the opening of the valve at the surface.

18. The method of claim 7 further including after the step of detonating the perforating gun, the step of detecting the detonating of the perforating gun.

19. The method of claim 7 further including prior to the step of suspending the pipe string, the step of biasing a firing pin on the firing mechanism towards the perforating gun.

20. The method of claim 19 further including after the step of transmitting the signal to the firing mechanism, the steps of compressing the means for biasing the firing pin, releasing the firing pin, and propelling the firing pin toward the perforating gun.

21. Apparatus disposed on a pipe string extending into a borehole, the pipe string having a flow bore and forming an annulus with the borehole, comprising:

packer means forming an upper annulus and a lower annulus;

valve means disposed in the pipe string for opening the flow bore to fluid flow to create a pressure differential between the upper annulus and the flow bore;

pressure responsive means disposed on the pipe string above the packer and exposed to fluid pressure in the upper annulus for providing a signal upon the creation of said pressure differential;

aperture means on the pipe string for communicating that portion of the flow bore below said valve means with the lower annulus to permit fluid flow therebetween;

perforating means disposed on the pipe string for perforating the borehole in the lower annulus; and transmission means extending from said pressure responsive means in the upper annulus to said perforating means in the lower annulus for transmitting said signal to said perforating means for the detonation of said perforating means.

22. The apparatus of claim 21 wherein said signal includes a force caused by said pressure responsive means in response to the creation of said pressure differential, said force being transmitted by said transmission means to said perforating means to actuate a firing head in said perforating means, detonate said perforating means and perforate said borehole.

23. Apparatus according to claim 22 wherein said transmission means includes a fluid pressure conduit extending from said pressure responsive means to said perforating means.

24. The apparatus of claim 21 wherein said pressure responsive means includes an annular chamber having a piston member disposed therein, said chamber being in fluid communication with the flow bore on one side of said piston member and in fluid communication with the upper annulus on the other side of said piston member, said piston reciprocating within said chamber upon creating a pressure differential between the upper annulus and the flow bore.

25. The apparatus of claim 24 wherein said piston member moves upwardly upon the creation of said pressure differential, and said transmission means includes a force transmitting member attached to said perforating means on the end and to a firing head in said perforating means on the other end, said force transmitting member cocking said firing head as said piston member moves said force transmitting member.

26. The apparatus of claim 24 wherein said piston member includes seal means for sealing said piston member with the interior walls of said annular chamber.

27. The apparatus of claim 24 wherein said pressure responsive means includes shear means for preventing the reciprocation of said piston member until a predetermined pressure differential is achieved.

28. The apparatus of claim 21 wherein said pressure responsive means includes a first chamber having a first piston member disposed therein, said first chamber being in fluid communication with the upper annulus on one side of said first piston member;

said transmission means including a fluid pressure conduit extending from said first chamber on the other side of said first piston member to a firing head in said perforating means;

said firing head including a second chamber having a second piston member disposed therein, said second chamber being in fluid communication with the flow bore on one side of said second piston member and said second chamber being in fluid communication with said fluid pressure conduit on the other side of said second piston member; and said first piston member forcing fluid through said fluid pressure conduit upon the creation of said pressure differential, said second piston member reciprocating within said second chamber upon the application of pressure through said fluid pressure conduit by said first piston member, said firing head moving into a cocking position as said second piston member reciprocates in said second chamber in response to the fluid pressure from said fluid pressure conduit.

29. The apparatus of claim 21 wherein said perforating means includes firing head means having a firing pin disposed on one end of a shaft member, biasing means for biasing said firing pin towards said perforating gun, and a shear connection between said shaft member and said firing pin, said shear connection shearing upon a predetermined compression of said biasing means, said transmission means moving said shaft member to compress said biasing means, said firing pin being biased into engagement with said perforating gun for the detonation thereof upon the shearing of said shear connection.

30. An actuator apparatus for a perforating gun, comprising:

a tubular member adapted for suspension in a well;

a piston member movably disposed on said tubular member and movable on said tubular member upon the creation of a pressure differential across said piston member;

a firing mechanism disposed in said tubular member having a firing pin for engagement with the perforating gun to detonate the gun; the firing pin being disposed below the piston member;

a packer disposed on said tubular member below said piston member and above said firing pin; the piston member being operative to receive fluid pressure from outside the tubular member and above the packer;

a pressure transmitting member extending from said piston member to said firing mechanism for applying pressure to and moving said firing mechanism to a firing position;

said piston member displacing fluid in said pressure transmitting member to hydraulically move said firing mechanism to said firing position in response to said pressure differential; and releasable means for releasably connecting said firing pin to said firing mechanism, said releasable means releasing said firing pin from said firing mechanism upon said firing mechanism being moved to said firing position, said firing pin moving into engagement with the perforating gun to detonate the gun upon the release of said firing pin from said firing mechanism.

31. The actuator apparatus of claim 30 wherein said pressure transmitting member includes a fluid conduit extending from said piston member to said firing mechanism.

32. The actuator apparatus of claim 30 further including apertures in said tubular member, firing mechanism, and firing pin to equalize the pressure around said firing pin with the pressure at the exterior of said tubular member.

33. The actuator apparatus of claim 30 wherein said pressure transmitting member is housed within said tubular member.

34. The actuator apparatus of claim 30 wherein said tubular member includes a annular chamber having a first opening communicating with the exterior of said tubular member and a second opening communicating with the interior of said tubular member; said piston member being movably disposed within said annular chamber such that one side of said piston member is subjected to fluid pressures at the exterior of said tubular member by means of said first opening and another side of said piston member is subjected to the fluid in the pressure transmitting member by means of said second opening.

35. The actuator apparatus of claim 30 further including seal means disposed on said piston member for sealingly engaging the walls forming said annular chamber.

36. The actuator apparatus of claim 30 further including biasing means engaging said tubular member for biasing said firing pin towards the perforating gun.

37. The actuator apparatus of claim 30 further including shear means for releasably holding said piston member in a fixed position until a predetermined pressure is effected on said one side of said piston member.

38. The actuator apparatus of claim 30 further including choke means for restricting the passage through said pressure transmitting member.

39. The actuator apparatus of claim 30 wherein said releasable means includes a second piston member reciprocably disposed in a cylinder of said firing mechanism, said cylinder being in fluid communication with said pressure transmitting member and having one end attached to said firing pin.

40. The actuator apparatus of claim 39 wherein said releasable means further includes shear means for releasably connecting said second piston member to said firing pin whereby said shear means shears upon the application of a predetermined force on said firing pin.

41. The actuator apparatus of claim 39 further including biasing means on said second piston member for biasing said firing pin towards the perforating gun whereby as said first recited piston member moves, said pressure transmitting means displaces fluid into said cylinder causing said second piston member and firing pin to move away from the perforating gun until the force of said biasing means on said firing pin shears said shear means and said firing pin moves into engagement with the perforating gun due to said biasing means to fire the perforating gun.

* * * * *